US008049588B2

(12) United States Patent
Shibuya et al.

(10) Patent No.: US 8,049,588 B2
(45) Date of Patent: Nov. 1, 2011

(54) COIL DEVICE

(75) Inventors: Tomonori Shibuya, Mie (JP); Tsunetsugu Imanishi, Mie (JP)

(73) Assignee: Panasonic Corporation, Osaka (JP)

( * ) Notice: Subject to any disclaimer, the term of this patent is extended or adjusted under 35 U.S.C. 154(b) by 195 days.

(21) Appl. No.: 12/519,833

(22) PCT Filed: Nov. 17, 2008

(86) PCT No.: PCT/JP2008/003337

§ 371 (c)(1),
(2), (4) Date: Jun. 18, 2009

(87) PCT Pub. No.: WO2009/066433

PCT Pub. Date: May 28, 2009

(65) Prior Publication Data

US 2010/0328003 A1 Dec. 30, 2010

(30) Foreign Application Priority Data

Nov. 21, 2007 (JP) ..... 2007-301498

(51) Int. Cl.
*H01F 27/02* (2006.01)

(52) U.S. Cl. ..... 336/83

(58) Field of Classification Search ..... 336/65, 336/83, 90–96, 107, 192, 200, 220–223, 336/232; 257/531
See application file for complete search history.

(56) References Cited

U.S. PATENT DOCUMENTS

| | | | | |
|---|---|---|---|---|
| 6,587,025 | B2 * | 7/2003 | Smith et al. | 336/200 |
| 6,791,444 | B1 * | 9/2004 | Masuda et al. | 336/83 |
| 7,425,883 | B2 * | 9/2008 | Matsutani et al. | 336/83 |
| 7,733,204 | B2 * | 6/2010 | Hahn et al. | 336/83 |
| 7,907,043 | B2 | 3/2011 | Mori | |
| 2005/0012581 | A1 * | 1/2005 | Ono et al. | 336/90 |

FOREIGN PATENT DOCUMENTS

| | | | |
|---|---|---|---|
| JP | 52-54859 | | 4/1977 |
| JP | 2003-168610 | A | 6/2003 |
| JP | 2004-266120 | A | 9/2004 |
| JP | 2004-311473 | | 11/2004 |
| JP | 2004-311473 | A | 11/2004 |
| JP | 2006-004957 | A | 1/2006 |
| WO | 2007-063884 | A1 | 6/2007 |
| WO | 2008-069098 | A1 | 6/2008 |

OTHER PUBLICATIONS

International Search Report for PCT/JP2008/003337.
Japanese Office action for JP2009-513144 dated Apr. 19, 2011.

* cited by examiner

*Primary Examiner* — Tuyen Nguyen
(74) *Attorney, Agent, or Firm* — Pearne & Gordon LLP

(57) ABSTRACT

A coil device includes first and second coils and a package for sealing the first and second coil. The first coil has a first winding including a first conductor wire wound about a first winding axis, and first and second ends which are both ends of the first conductor wire. The second coil has a second winding including a second conductor wire wound about a second winding axis, and third and fourth ends which are both ends of the second conductor wire. The second winding axis is arranged with the first winding axis. The second end of the first coil is connected with the third end of the second coil. The first end of the first coil and the fourth end of the second coil are adapted to be connected to an outside of the package. This coil device reduces magnetic flux leakage to outside of the package.

17 Claims, 18 Drawing Sheets

Fig. 7

| | Center Width LM (mm) | Outer Width LE,LF(mm) | Top Width LH Bottom Width LB (mm) | Leakage Magnetic Flux Density (mT) | | | | Inductance (μH) | Volume of Package ($mm^3$) |
|---|---|---|---|---|---|---|---|---|---|
| | | | | P1 | P2 | P3 | P4 | | |
| Example 1 | 1 | 1.8 | 3.4 | 1.5 | 1.5 | 1.2 | 1.2 | 7.7 | 1908 |
| Example 2 | 1 | 1.8 | 3.4 | 1.7 | 1.7 | 1.6 | 1.6 | 7.8 | 1908 |
| Example 3 | 1 | 1.8 | 3.4 | 1.7 | 1.7 | 1.6 | 1.6 | 7.9 | 1908 |
| Example 4 | 1 | 1.8 | 3.4 | 1.6 | 1.6 | 1.2 | 1.2 | 7.8 | 1908 |
| Example 5 | 1 | 1.8 | 3.4 | 1.6 | 1.6 | 1.5 | 1.4 | 7.5 | 1908 |
| Comparative Example | - | 1.8 | 3.4 | 3.9 | 3.9 | 2.9 | 2.8 | 7.5 | 1908 |

Fig. 8

| | Center Width LM (mm) | Outer Width LE,LF(mm) | Top Width LH Bottom Width LB (mm) | Leakage Magnetic Flux Density (mT) | | | | Inductance (μH) | Volume of Package ($mm^3$) |
|---|---|---|---|---|---|---|---|---|---|
| | | | | P1 | P2 | P3 | P4 | | |
| Example 6 | 0.1 | 1.8 | 3.4 | 1.3 | 1.2 | 1.1 | 1.1 | 8.2 | 1775 |
| Example 7 | 1 | 1.8 | 3.4 | 1.5 | 1.5 | 1.2 | 1.2 | 7.7 | 1908 |
| Example 8 | 3 | 1.8 | 3.4 | 1.5 | 1.5 | 1.3 | 1.4 | 7.7 | 2206 |
| Comparative Example | - | 1.8 | 3.4 | 3.9 | 3.9 | 2.9 | 2.8 | 7.5 | 1908 |

Fig. 9

| | Center Width LM (mm) | Outer Width LE,LF(mm) | Top Width LH Bottom Width LB (mm) | Leakage Magnetic Flux Density (mT) | | | | Inductance (μH) | Volume of Package ($mm^3$) |
|---|---|---|---|---|---|---|---|---|---|
| | | | | P1 | P2 | P3 | P4 | | |
| Example 9 | 1 | 1 | 3.4 | 1.9 | 1.9 | 1.7 | 1.7 | 8.2 | 1671 |
| Example 10 | 1 | 1.8 | 3.4 | 1.5 | 1.5 | 1.2 | 1.2 | 7.7 | 1908 |
| Example 11 | 1 | 2.8 | 3.4 | 1.4 | 1.4 | 0.8 | 0.8 | 8.0 | 2206 |
| Example 12 | 1 | 3.7 | 3.4 | 1.4 | 1.4 | 0.6 | 0.5 | 8.0 | 2474 |
| Comparative Example | - | 1.8 | 3.4 | 3.9 | 3.9 | 2.9 | 2.8 | 7.5 | 1908 |

Fig. 10

| | Center Width LM (mm) | Outer Width LE,LF(mm) | Top Width LH Bottom Width LB (mm) | Leakage Magnetic Flux Density (mT) | | | | Inductance (μH) | Volume of Package ($mm^3$) |
|---|---|---|---|---|---|---|---|---|---|
| | | | | P1 | P2 | P3 | P4 | | |
| Example 13 | 1 | 1.8 | 1 | 6.6 | 6.5 | 1.6 | 1.6 | 7.1 | 1132 |
| Example 14 | 1 | 1.8 | 2 | 3.3 | 3.3 | 1.4 | 1.4 | 7.7 | 1456 |
| Example 15 | 1 | 1.8 | 3.4 | 1.5 | 1.5 | 1.2 | 1.2 | 7.7 | 1908 |
| Example 16 | 1 | 1.8 | 4 | 1.2 | 1.2 | 1.2 | 1.2 | 8.0 | 2103 |
| Example 17 | 1 | 1.8 | 5 | 0.8 | 0.8 | 1.0 | 1.0 | 8.0 | 2426 |
| Comparative Example | - | 1.8 | 3.4 | 3.9 | 3.9 | 2.9 | 2.8 | 7.5 | 1908 |

Fig. 12

| | Center Width LM (mm) | Outer Width LE,LF(mm) | Top Width LH Bottom Width LB (mm) | Leakage Magnetic Flux Density (mT) | | | | Inductance (μH) | Volume of Package ($mm^3$) |
|---|---|---|---|---|---|---|---|---|---|
| | | | | P1 | P2 | P3 | P4 | | |
| Example 1 | 1 | 1.8 | 3.4 | 1.5 | 1.5 | 1.2 | 1.2 | 7.7 | 1908 |
| Example 18 | 1 | 1.8 | 3.4 | 1.5 | 1.5 | 1.2 | 1.2 | 7.6 | 1908 |
| Comparative Example | - | 1.8 | 3.4 | 3.9 | 3.9 | 2.9 | 2.8 | 7.5 | 1908 |

COIL DEVICE

TECHNICAL FIELD

The present invention relates to a coil device for use in various electrical circuits.

BACKGROUND ART

FIG. 16 is a perspective view of conventional coil device 1. FIGS. 17 and 18 are sectional views of coil device 1. Coil device 1 includes winding 3, package 2A for sealing winding 3, and external terminals 4A electrically connected to winding 3. Respective portions of external terminals 4A are exposed to the outside of package 2A.

In coil device 1, upon having a current supplied, winding 3 generates magnetic flux 5, which may leak outside package 2A, i.e., coil device 1 while being emitted from winding 3. In the case that coil device 1 is mounted with other devices highly-densely, effects of coil device 1 on the devices are considered. Patent Documents 1 and 2 disclose conventional coil devices preventing the leakage of magnetic flux.

Package 2A may be made of magnetic material to reduce the effects. In order to increase the reduction of the leakage of the magnetic flux with the magnetic material, package 2A is generally made of magnetic material having a high magnetic permeability, has a large size, or includes shields 6A having a magnetic shielding effect.

These approaches, however, have the following problems. Package 2A made of the magnetic material having the high magnetic permeability can hardly be molded, thus having its cost increase. More specifically, package 2A can hardly be molded with a high-pressure pressing machine, which increases the density of the magnetic material of package 2A. In addition, the magnetic material having the high magnetic permeability containing amorphous magnetic powder or Ni is expensive. Package 2A having a large size increases the size of coil device 1, and accordingly causes other devices to be arranged less densely. Further, shields 6A attached to package 2A causes energy loss due to eddy currents generated in shields 6A and increases material cost.

Patent Document 1: JP 2003-168610A

Patent Document 2: JP 2004-266120A

SUMMARY OF THE INVENTION

A coil device includes first and second coils and a package for sealing the first and second coil. The first coil has a first winding including a first conductor wire wound about a first winding axis, and first and second ends which are both ends of the first conductor wire. The second coil has a second winding including a second conductor wire wound about a second winding axis, and third and fourth ends which are both ends of the second conductor wire. The second winding axis is arranged with the first winding axis. The second end of the first coil is connected with the third end of the second coil. The first end of the first coil and the fourth end of the second coil are adapted to be connected to an outside of the package.

This coil device reduces magnetic flux leakage to outside of the package.

BRIEF DESCRIPTION OF THE DRAWINGS

FIG. 7 shows leakage magnetic flux densities of the coil devices according to Embodiment 2.

FIG. 8 shows leakage magnetic flux densities of the coil devices according to Embodiment 2.

FIG. 9 shows leakage magnetic flux densities of the coil device according to Embodiment 2.

FIG. 10 shows leakage magnetic flux densities of the coil devices according to Embodiment 2.

FIG. 12 shows leakage magnetic flux densities of the coil device shown in FIGS. 11A and 11B.

REFERENCE NUMERALS

8 Winding (First Winding)
8A Conductor Wire (First Conductor Wire)
9 Winding (Second Winding)
9A Conductor Wire (Second Conductor Wire)
10A End (First End)
10B End (Second End)
11A End (Fourth End)
11B End (Third End)
12 Coil (First Coil)
13 Coil (Second Coil)
14 Package
15 External Terminal (First External Terminal)
16 External Terminal (Second External Terminal)
17 Winding Axis (First Winding Axis)
18 Winding Axis (Second Winding Axis)
22 Linear Portion (First Linear Portion)
23 Linear Portion (Second Linear Portion)
24 Outer Periphery, Arcuate Portion (First Outer Periphery, First Arcuate Portion)
25 Outer Periphery, Arcuate Portion (Second Outer Periphery, Second Arcuate Portion)
30 Upper Surface
32 Lower Surface

34A Side Surface (First Side Surface)
34B Side Surface (Second Side Surface)
112 Coil (First Coil)
113 Coil (Second Coil)
114 Package

DETAILED DESCRIPTION OF PREFERRED EMBODIMENTS

Exemplary Embodiment 1

Figure 1:
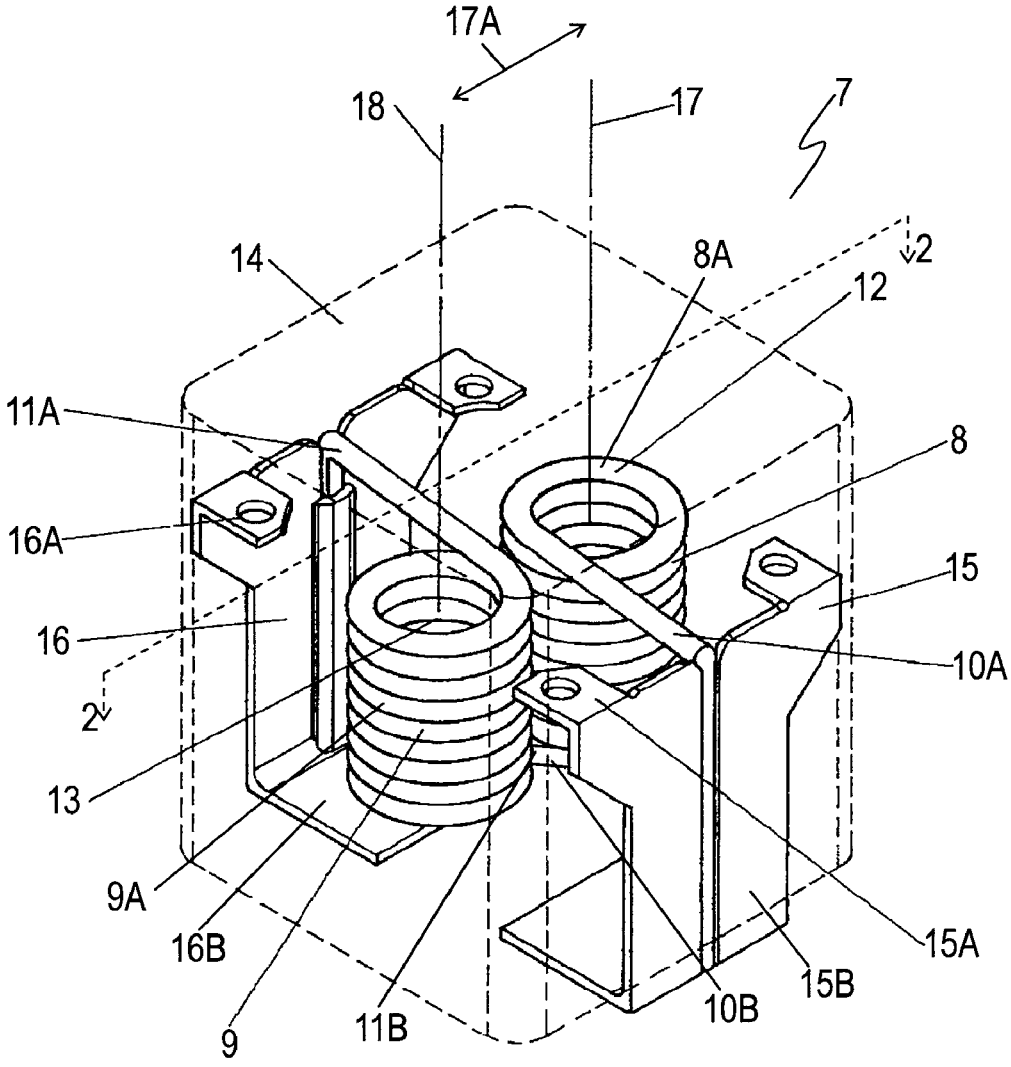
FIG. 1 is a perspective view of a coil device according to Exemplary Embodiment 1 of the present invention.

FIG. 1 is a perspective view of coil device 7 according to Exemplary Embodiment 1 of the present invention. Coil device 7 includes cylindrical solenoid coils 12 and 13 and package 14 for sealing coils 12 and 13. Coil 12 includes winding 8 having conductor wire 8A helically wound about winding axis 17, and ends 10A and 10B, both ends of conductor wire 8A. Coil 13 includes winding 9 having conductor wire 9A helically wound about winding axis 18, and ends 11A and 11B, both ends of conductor wire 9A. Ends 10A and 10B of coils 12 and 13 are connected to external terminals 15 and 16, respectively, and are exposed to an outside of package 14. Ends 10B and 11B of coils 12 and 13 are connected to each other inside package 14. Windings 8 and 9 are adjacently arranged in predetermined direction 17A such that coils 12 and 13, i.e., winding axes 17 and 18, are substantially parallel to each other. More specifically, winding axes 17 and 18 are arranged in direction 17A, and hence, coils 12 and 13 (windings 8 and 9) are arranged in direction 17A. Package 14 is made of magnetic material. External terminal 15 includes fixed portion 15A and connecting portion 15B. Fixed portion 15A is embedded in package 14 so as to fix external terminal 15 to package 14. Connecting portion 15B is exposed from package 14 to be adapted to be connected to an outside of coil device 7 (package 14). External terminal 16 includes fixed portion 16A and connecting portion 16B. Fixed portion 16A is embedded in package 14 so as to fix external terminal 16 to package 14. Connecting portion 16B is exposed from package 14 and is adapted to be connected to an outside of coil device 7 (package 14). Thus, ends 10A and 10B of coils 12 and 13 are adapted to be connected to the outside of package 14.

Figure 2:
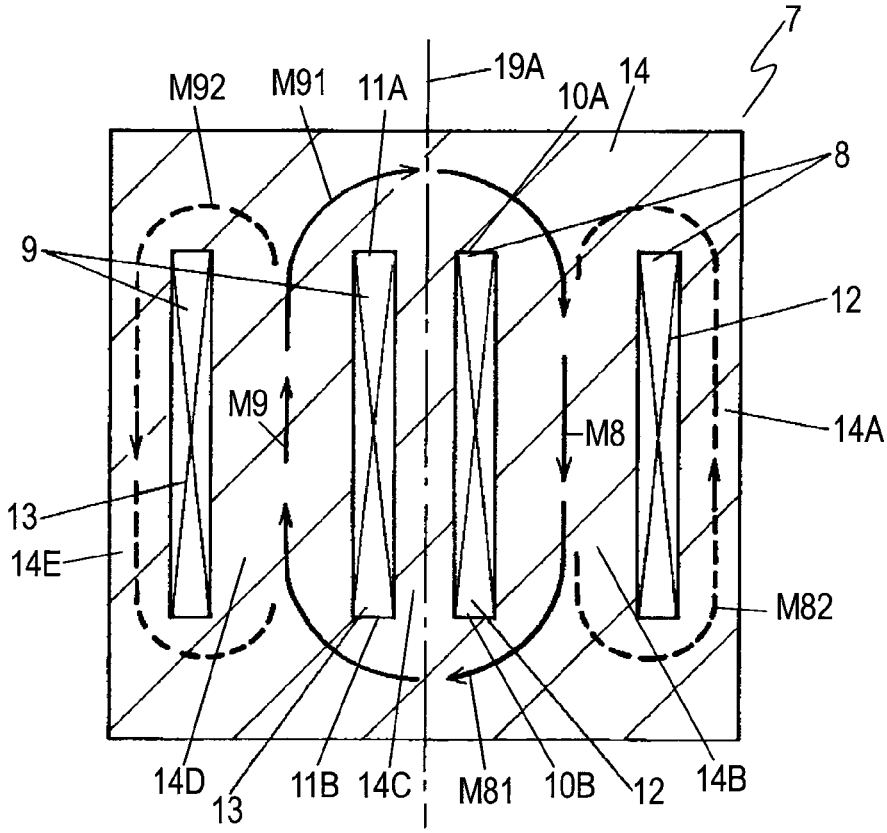
FIG. 2 is a sectional view of the coil device at line 2-2 shown in FIG. 1.

FIG. 2 is a sectional view of coil device 7 at line 2-2 shown in FIG. 1 for illustrating a cross section of coil device 7 on a plane including winding axes 17 and 18. As shown in FIG. 2, windings 8 and 9 are adjacently arranged so that winding axes 17 and 18 are parallel to each other. Package 14 includes portion 14B located in winding 8, portion 14D located in winding 9, portion 14C located between windings 8 and 9, portion 14A located opposite to portion 14C with respect to winding 8, and portion 14E located opposite to portion 14C with respect to winding 9. In other words, portions 14A and 14E are located outside windings 8 and 9. Winding 8 generates magnetic flux M8 in winding 8. Winding 9 generates magnetic flux M9 in winding 9. Magnetic fluxes M8 and M9 flow in directions opposite to each other. Magnetic flux M8 flows out of winding 8 and is divided into magnetic fluxes M81 and M82. Magnetic flux M81 flows from winding 8 into winding 9, whereas magnetic flux M82 flows through portion 14A of package 14. Magnetic flux M81 is a most part of magnetic flux M8 and is larger than magnetic flux M82. Magnetic flux M9 flowing out of winding 9 is divided into magnetic fluxes M91 and M92. Magnetic flux M91 flows from winding 9 into winding 8, whereas magnetic flux M92 flows through portion 14E of package 14. Magnetic flux M91 is a most part of magnetic flux M9 and is larger than magnetic flux M92. In portion 14C of package 14, the magnetic fluxes generated by windings 8 and 9 offset each other, thus producing substantially no magnetic flux. Coils 12 and 13 are connected to each other, and conductor wires 8A and 9A are wound so that magnetic fluxes M81 and M91 flow in a loop shape through windings 8 and 9. This arrangement allows portions 14B and 14C of package 14 to substantially function as a toroidal core so as to form an inner-core magnetic circuit, thereby increasing magnetic efficiency of coil device 7.

Portions 14A and 14E of package 14 having magnetic fluxes M82 and M92 flowing therethrough prevent magnetic flux from leaking to an outside of package 14, and also maintain mechanical strength of package 14.

As shown in FIG. 1, fixed portions 15A and 16A of external terminals 15 and 16 are located in portions 14A and 14E of package 14 which are outside windings 8 and 9. Magnetic fluxes M81 and M91 which are the most parts of the magnetic fluxes flow in the loop, and package 14 approximates a toroidal core. This structure prevent comparatively large magnetic fluxes M81 and M91 from crossing fixed portions 15A and 16A, hence preventing the sizes or shapes of fixed portions 15A and 16A from affecting magnetic fluxes M81 and M91. This enables external terminals 15 and 16 to be securely fixed to package 14, thereby improving a mounting reliability of coil device 7.

Coils 12 and 13 (windings 8 and 9) are symmetrical with respect to center line 19A of package 14. Canter line 19A extends between windings 8 and 9 substantially parallel to winding axes 17 and 18. Windings 8 and 9 are symmetrical with respect to a plane located between windings 8 and 9. This structure balances magnetic fluxes M81 and M91, and hence, balances a magnetroresistance between windings 8 and 9 in package 14, thereby preventing magnetic flux from leaking locally. Coils 12 and 13 (windings 8 and 9) are located at the center of package 14 in the direction along center line 19A. This allows magnetic fluxes M81 and M91 to flow through the most efficient area having a low magnetroresistance, thereby reducing magnetic flux leakage and reducing a direct-current (DC) resistance.

Winding axes 17 and 18 may not be necessarily exactly parallel to each other, but may be substantially parallel to each other geometrically to increase magnetic efficiency.

Exemplary Embodiment 2

Figure 3:
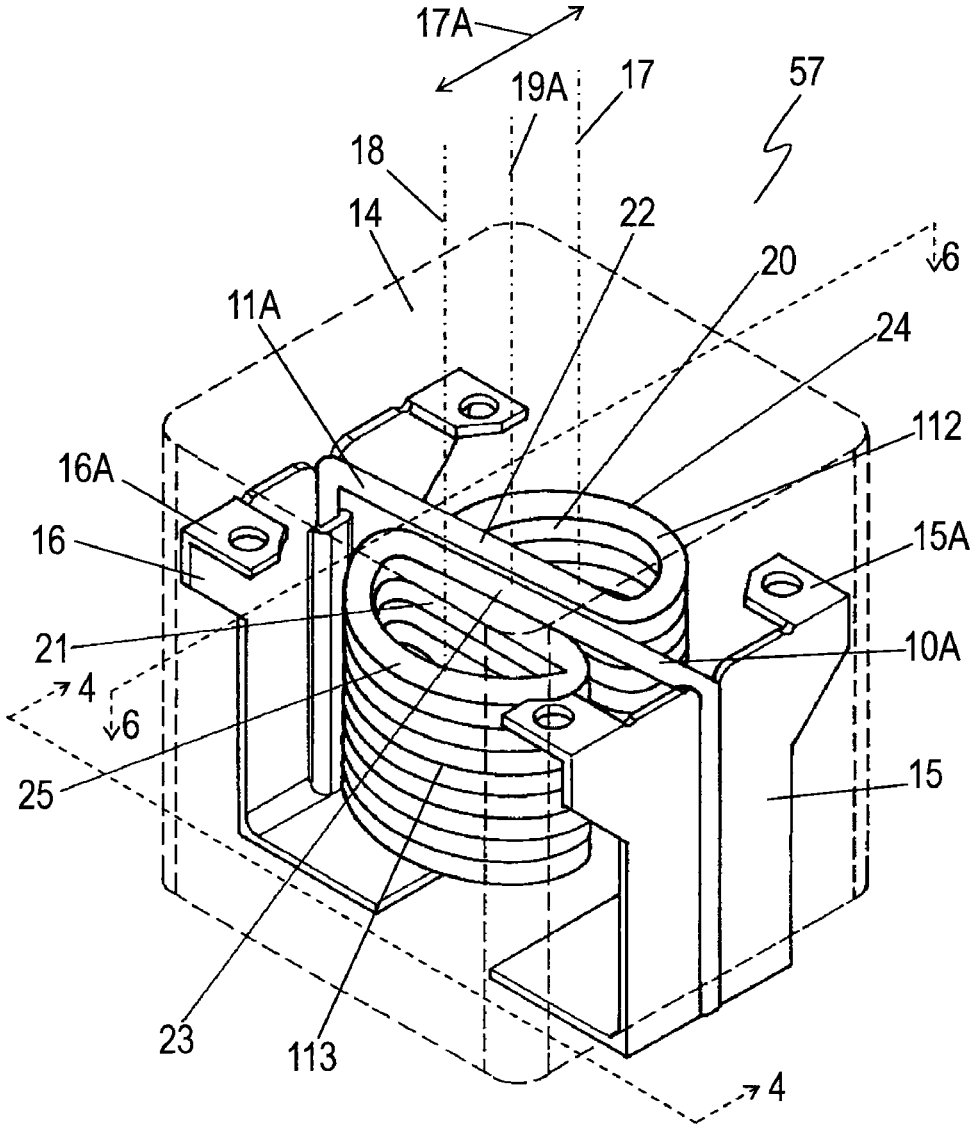
FIG. 3 is a perspective view of a coil device according to Exemplary Embodiment 2 of the invention.
Figure 4:
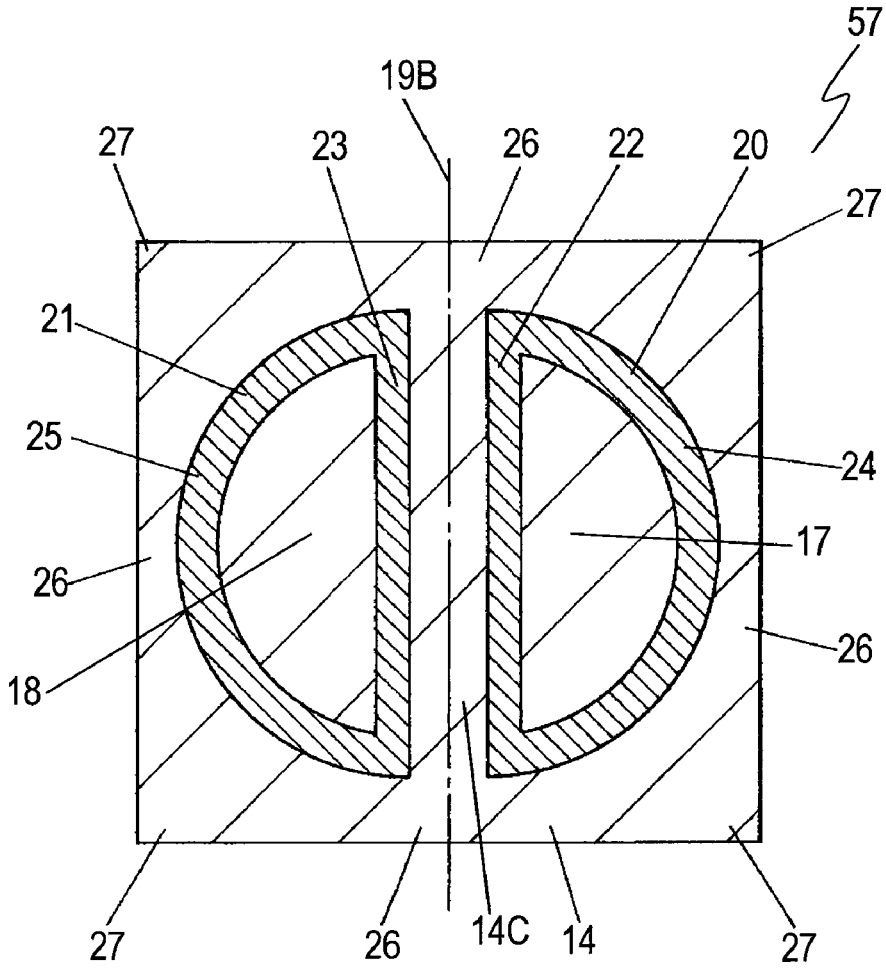
FIG. 4 is a sectional view of the coil device at line 4-4 shown in FIG. 3.

FIG. 3 is a perspective view of coil device 57 according to Exemplary Embodiment 2. FIG. 4 is a sectional view of coil device 57 at line 4-4 shown in FIG. 3. In FIGS. 3 and 4, components identical to those of coil device 7 according Embodiment 1 shown in FIGS. 1 and 2 are denoted by the same reference numerals, and their description will be omitted. Coil device 57 includes coils 112 and 113 having windings 20 and 21 instead of coils 12 and 13 of coil device 7 shown in FIG. 1. Windings 20 and 21 are adjacently arranged so that winding axes 17 and 18 are parallel to each other. In coil device 7 according to Embodiment 1 shown in FIG. 1, coils 12 and 13 are common cylindrical solenoid coils and have circular cross sections in a direction perpendicular to winding axes 17 and 18 of coils 12 and 13 (windings 8 and 9). On the other hand, as shown in FIGS. 3 and 4, winding 20 has a partial circular cross section perpendicular to winding axis 17. The partial circular shape is formed of linear portion 22 and arcuate portion 24 which is an outer periphery of winding 20. Winding 21 has a partial circular cross section perpendicular to winding axis 18. The partial circular shape is formed of linear portion 23 and arcuate portion 25 which is an outer periphery of winding 21. Arcuate portions 24 and 25 are located outside linear portions 22 and 23. Windings 20 and 21 are sealed with package 14. FIG. 4 shows cross sections of windings 20 and 21 in a direction perpendicular to winding axes 17 and 18. Windings 20 and 21 are symmetrical to each other with respect to center line 19A of package 14. Center line 19A extends between windings 20 and 21 and in parallel to winding axes 17 and 18. Windings 20 and 21 are symmetrical to each other with respect to center line 19B of package 14. Center line 19B extends between windings 20 and 21 and perpendicularly to winding axes 17 and 18. Linear portions 22 and 23 face each other across portion 14C located between windings 20 and 21 of package 14. This structure allows the magnetic fluxes generate by windings 20 and 21 to flow along a magnetic circuit having a short flux path. The partial circular shape of windings 20 and 21 provide windings 20 and 21 with have large cross sectional areas. This structure provides coil device 57 with a large inductance to an alternating-current (AC) current, a small DC resistance, and prevents the magnetic flux from leaking.

As shown in FIG. 4, package 14 includes side portions 26 which are located in directions in which linear portions 22 and 23 of windings 20 and 21 extend, and four corners 27. Although side portions 26 are thin, four corners 27 have large cross sectional areas, accordingly providing package 14 with large strength. Package 14 may be formed by pressure-molding composite magnetic material made of magnetic material and resin. In this case, in spite of thin side portions 26, the large cross sectional areas at corners 27 prevent package 14 from having cracks produced due to elastic deformation of windings 20 and 21 made of conductive material, such as metal.

Windings 20 and 21 have the partial circular cross sections consisting of linear portions 22 and 23 and arcuate portions 24 and 25, however, may have other shapes. FIGS. 5A to 5D show sectional views of other windings 20A to 20D and 21A to 21D of coil device 57 according to Embodiment 2. In FIGS. 5A to 5D, components identical to those of the device shown in FIG. 4 are denoted by the same reference numerals, and their description will be omitted. Windings 20A to 20D and 21A to 21D are sealed with package 14.

Figure 5A:
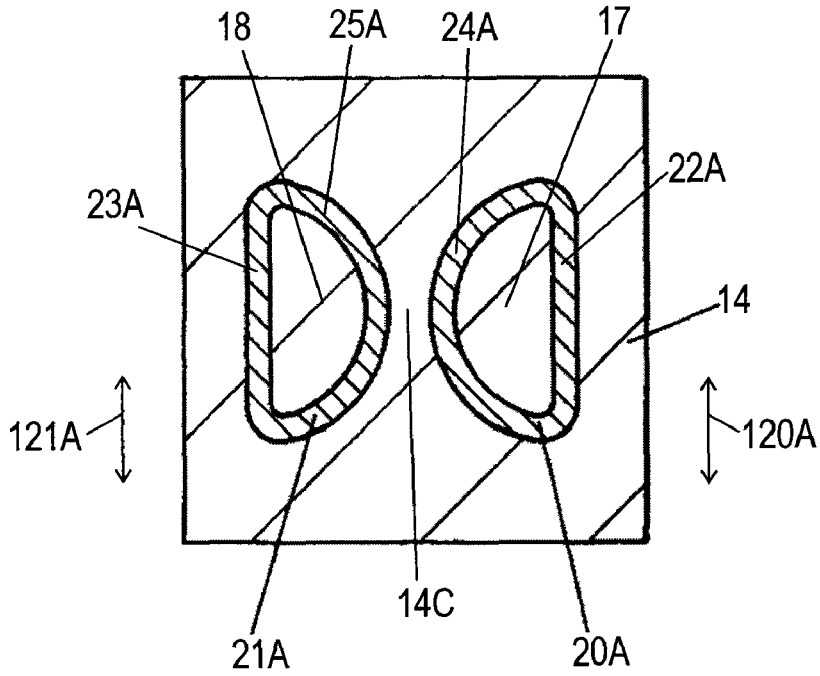
FIG. 5A is a sectional view of another coil device according to Embodiment 2.

As shown in FIG. 5A, winding 20A has a partial circular cross section perpendicular to winding axis 17. The cross section is formed of linear portion 22A and arcuate portion 24A. Winding 21A has a partial circular cross section perpendicular to winding axis 18. The cross section is formed of linear portion 23A and arcuate portion 25A. Linear portions 22A and 23A are located outside arcuate portions 24A and 25A. Arcuate portions 24A and 25A face each other across portion 14C of package 14 located between windings 20A and 21A.

Figure 5B:
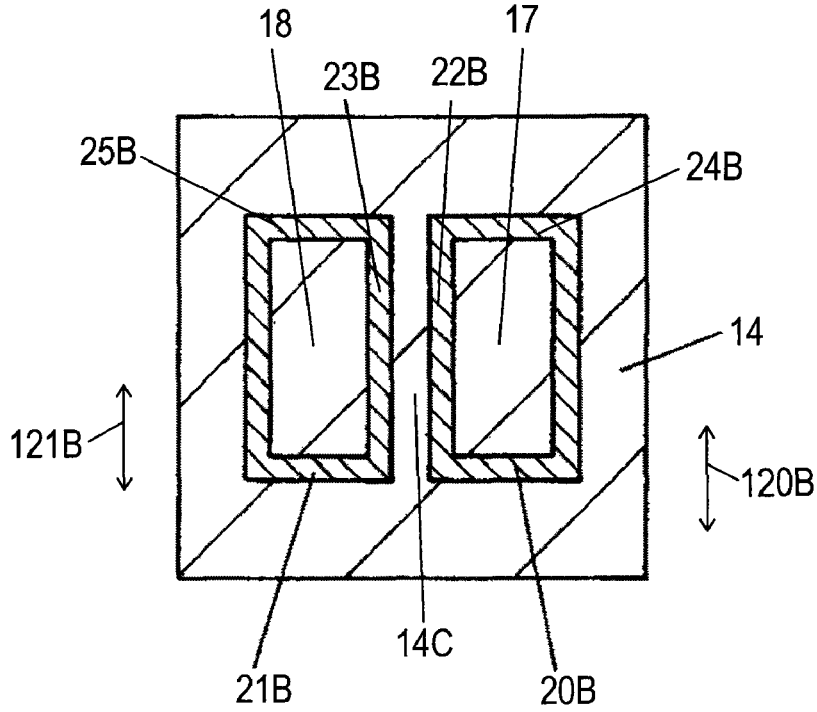
FIG. 5B is a sectional view of still another coil device according to Embodiment 2.

As shown in FIG. 5B, winding 20B has a rectangular cross section perpendicular to winding axis 17. The cross section is formed of long sides 22B and short sides 24B. Winding 21B has a rectangular cross section perpendicular to winding axis 18. The cross section is formed of long sides 23B and short sides 25B. Long sides 22B and 23B are longer than short sides 24B and 25B. Long sides 22B and 24B face each other across portion 14C of package 14 located between windings 20B and 21B. Long sides 22B and 23B are parallel to each other. More specifically, the cross sections of windings 20B and 21B in the direction perpendicular to winding axes 17 and 18 have longitudinal directions 120B and 121B parallel to long sides 22B and 23B, respectively. Longitudinal directions 120B and 121B are parallel to each other.

Figure 5C:
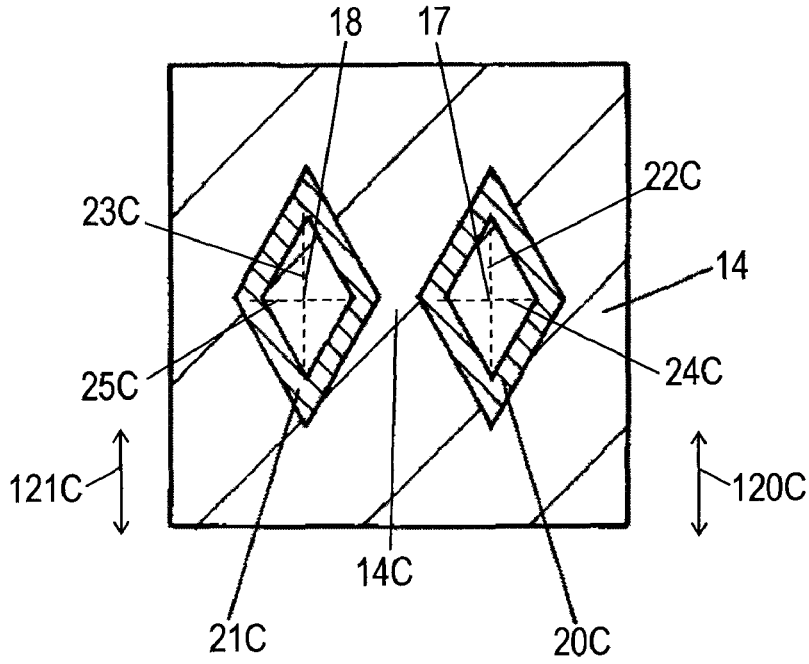
FIG. 5C is a sectional view of a further coil device according to Embodiment 2.

As shown in FIG. 5C, winding 20C has a rhombic cross section perpendicular to winding axis 17. This cross section has diagonals 22C and 24C. Winding 21C has a rhombic cross section perpendicular to winding axis 18. This cross section has diagonals 23C and 25C. Diagonals 22C and 23C are longer than diagonals 24C and 25C, and are parallel to each other. More specifically, the cross sections of windings 20C and 21C in the direction perpendicular to winding axes 17 and 18 have diagonals 22C and 23C parallel to longitudinal directions 120C and 121C which are parallel to each other.

Figure 5D:
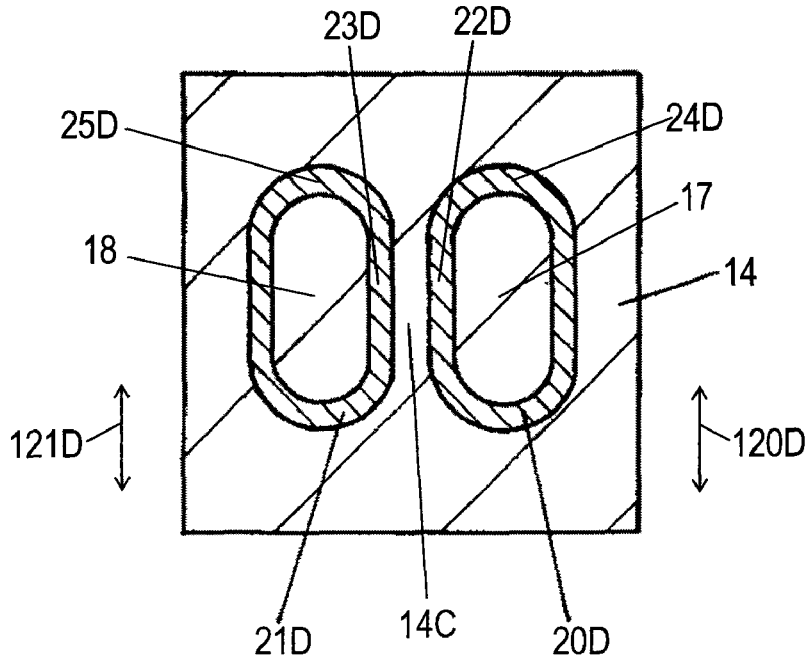
FIG. 5D is a sectional view of a further coil device according to Embodiment 2.

As shown in FIG. 5D, winding 20D has an oval cross section perpendicular to winding axis 17. This cross section is formed of linear portions 22D and arcuate portions 24D. Winding 21D has an oval cross section perpendicular to winding axis 18. This cross section is formed of linear portions 23D and arcuate portions 25D. Linear portions 22D and 23D face each other across portion 14C of package 14 located between windings 20D and 21D. Linear portions 22D and 23D are parallel to each other. More specifically, the cross sections of windings 20D and 21D in the direction perpendicular to winding axes 17 and 18 have linear portions 22D and 24D which are parallel to longitudinal directions 120D and 121D which are parallel to each other.

Figure 6:
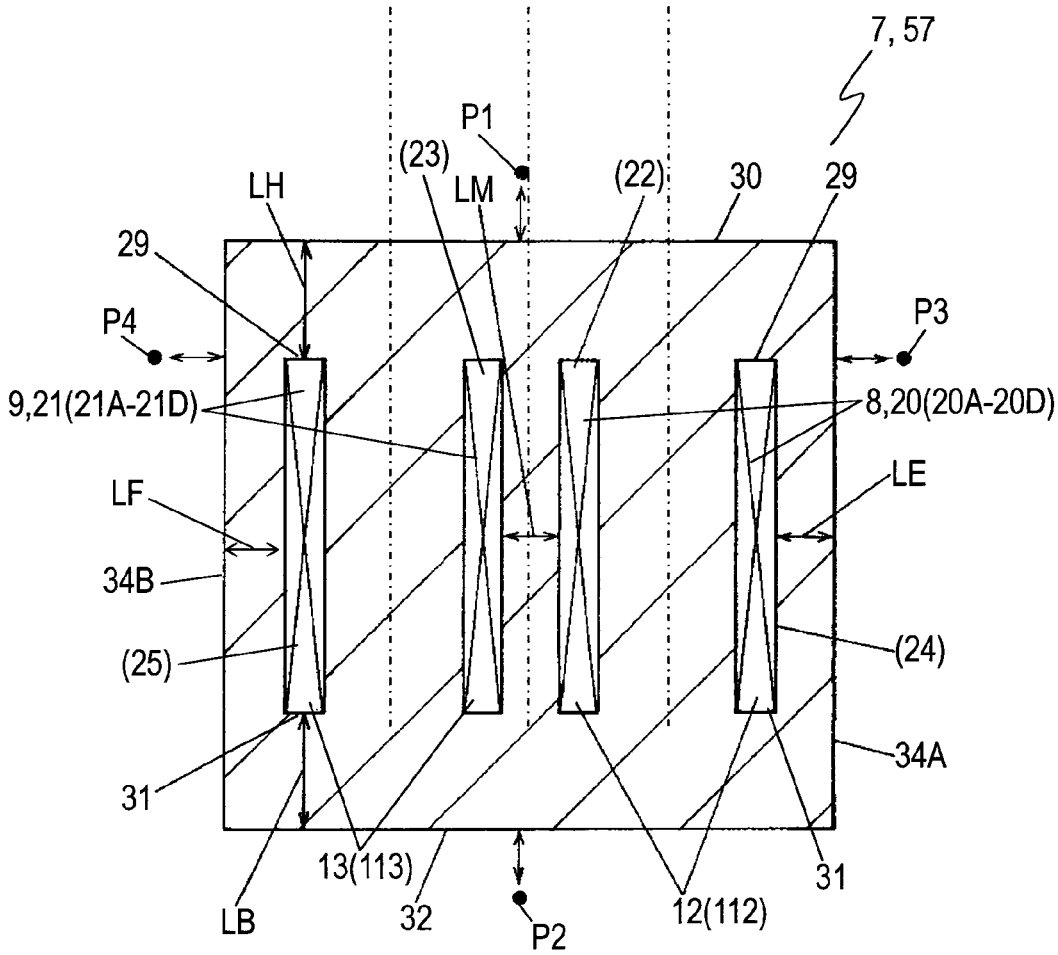
FIG. 6 is a sectional view of the coil device at line 6-6 shown in FIG. 3.
Figure 16:
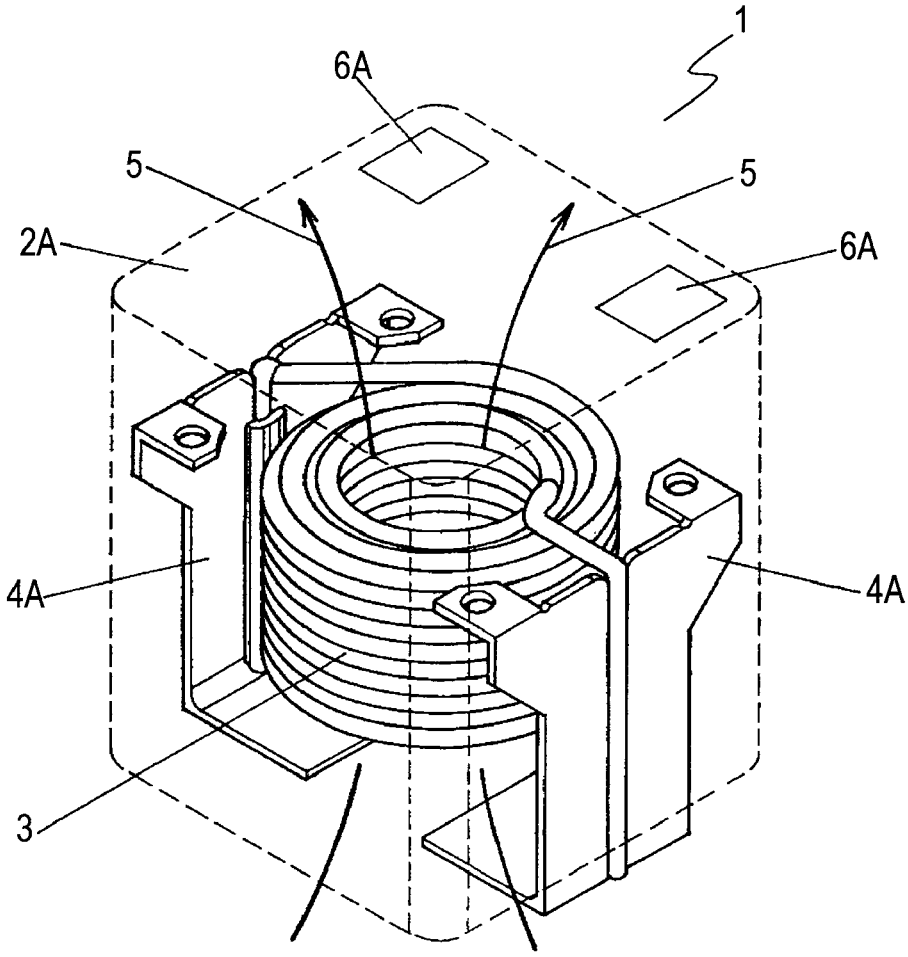
FIG. 16 is a perspective view of a conventional coil device.
Figure 17:
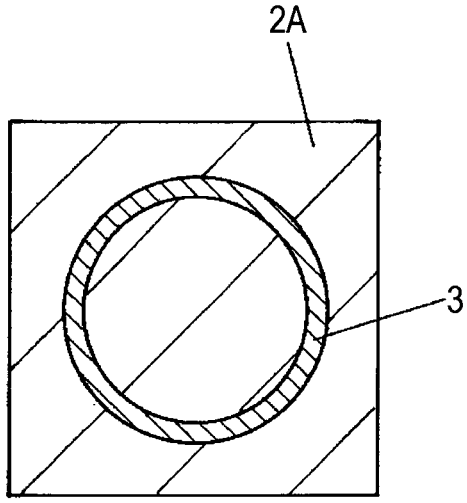
FIG. 17 is a first sectional view of the conventional coil device.

Samples of Examples 1 to 5 of coil device 57 according to Embodiment 2 were. The sample of Example 1 includes windings 20 and 21 shown in FIG. 4. The sample of Example 2 includes windings 20A and 21A shown in FIG. 5A. The sample of Example 3 includes windings 20B and 21B shown in FIG. 5B. The sample of Example 4 includes windings 20C and 21C shown in FIG. 5C. The sample of Example 5 includes windings 20D and 21D shown in FIG. 5D. A sample of Comparative Example of conventional coil device 1 shown in FIGS. 16 to 18 was produced. As shown in FIGS. 1, 3, and 16, packages 2A and 14 had substantially rectangular parallelepiped shapes. FIG. 6 is a sectional view of coil device 57 at line 6-6 shown in FIG. 3 for illustrating the cross section of coil device 57 on a plane including winding axes 17 and 18.

Figure 18:
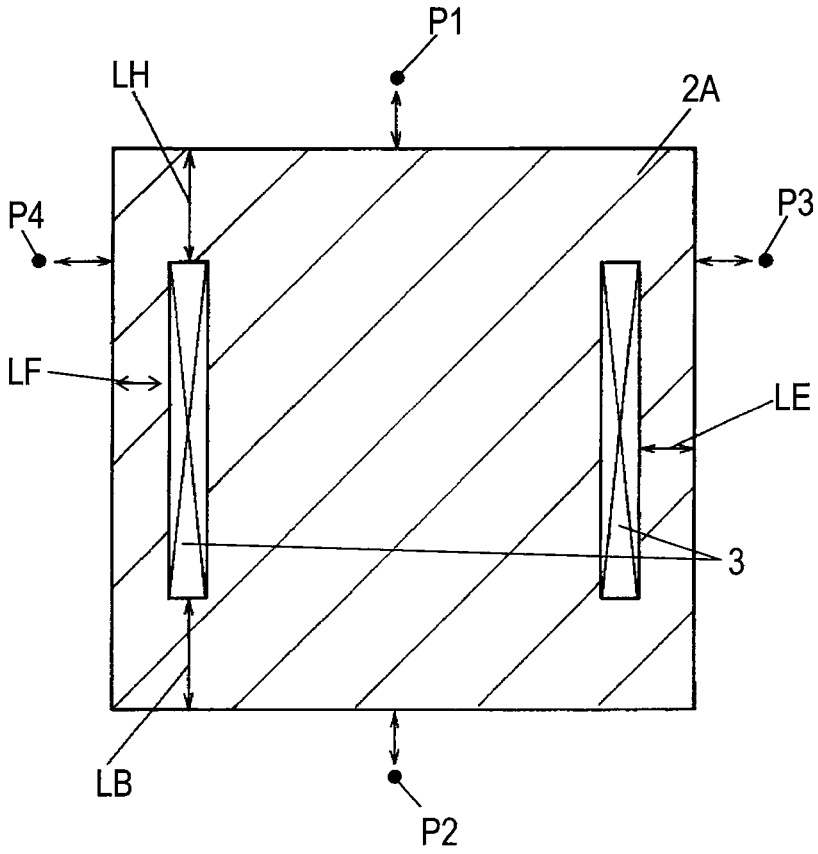
FIG. 18 is a second sectional view of the conventional coil device.

Package 14 of Examples 1 to 5 has upper surface 30, lower surface 32, and side surfaces 34A and 34B. Upper surface 30 is perpendicular to winding axes 17 and 18 and faces upper end 29 of each of windings 20, 20A to 20D, 21, and 21A to 21D. Lower surface 32 is perpendicular to winding axes 17 and 18 and faces lower end 31 of each of windings 20, 20A to 20D, 21, and 21A to 21D. Side surfaces 34A and 34B are opposite to each other and are perpendicular to direction 17A in which winding axes 17 and 18 are arranged. Side surface 34A faces each of windings 20 and 20A to 20D. Side surface 34B faces each of windings 21 and 21A to 21D. Each of coil devices 1 and 57 (packages 2A and 14) has a volume of about 1900 $mm^3$, and an inductance of about 7.7 μH. A center width LM, a predetermined distance between windings 20 and 21, between windings 20A and 21A, between windings 20B and 21B, between windings 20C and 21C, and between windings 20D and 21D was 1.0 mm. A top width LH, a predetermined distance between upper surface 30 and upper end of each of windings 20, 20A to 20D, 21, and 21A to 21D was 3.4 mm. A bottom width LB, a predetermined distance between lower surface 32 and lower end 31 of each of windings 20, 20A to 20D, 21, and 21A to 21D was 3.4 mm. An outer width LE, a predetermined distance between side surface 34A and each of windings 20 and 20A to 20D was 1.8 mm. An outer width LF, a predetermined distance between side surface 34B and each of windings 21 and 21A to 21D was 1.8 mm. Similarly, in the sample of Comparative Example of conventional coil device 1 shown in FIG. 17, top width LH was 3.4 mm, bottom width LB was 3.4 mm, outer widths LE and LF were 1.8 mm, as shown in FIG. 18. A current of 11A having a frequency of 100 kHz was supplied to the samples of Examples 1 to 5 and Comparative Example so as to measure leakage magnetic flux densities at positions P1 to P4. Positions P1, P2, P3, and P4 were located away by a distance of 1 mm from surfaces 30, 32, 34A, and 34B of package 14, respectively. Positions P1 and P2 were located on center line 19A, and positions P3 and P4 were located on a straight line connecting upper end 29 of winding 20 (20A to 20D) and upper end 29 of winding 21 (21A to 21D). FIG. 7 shows measured leakage magnetic flux densities of the samples of Examples 1 to 5 and Comparative Example.

As shown in FIG. 7, coil device 57 of Examples 1 to 5 in which winding axes 17 and 18 are parallel to each other and coils 12, 13, 112, and 113 sealed by package 14 made of magnetic body forms a inner-core magnetic circuit reduces magnetic flux leaking to an outside of package 14 significantly more than coil device 1 of Comparative Example.

Example 1 shown in FIG. 4 has a smaller leakage magnetic flux than Examples 2 to 5 shown in FIGS. 5A to 5D. More specifically, leakage magnetic flux can be reduced by arranging windings 20 and 21 such that linear portions 22 and 23 of windings 20 and 21 face each other and that arcuate portions 24 and 25 are located outside linear portions 22 and 23.

Linear portions 22 and 23 shown in FIG. 4 may not be necessarily exactly linear, but may be substantially linear to sufficiently reduce the leakage magnetic flux.

Arcuate portions 24 and 25 located outside linear portions 22 and 23 as the outer peripheries of windings 20 and 21 may not necessarily have the exactly arcuate-shapes. A similar effect can be obtained by decreasing the region surrounded by windings 20 and 21 as the distance from linear portions 22 and 23 toward the outer surface of package 14 decreases.

The top width LH and the bottom width LB are preferably equal to each other. This arrangement allows magnetic fluxes M81 and M91 to flow efficiently in a loop in package 14 shown in FIG. 2.

As shown in FIG. 3, windings 20 and 21 have ends 10A and 10B connected to external terminals 15 and 16 and led out to the outside of package 14, respectively. Ends 10A and 10B extend substantially linearly in a direction in which linear portions 22 and 23 extend. This arrangement reduces effects of ends 10A and 10B on the magnetic flux flowing in windings 20 and 21. As a result, coil device 57 has a low leakage magnetic flux, and has inductances of windings 20 and 21 with a small loss.

Other samples of coil device 57 of FIG. 3 having windings 20 and 21 and various sizes of package 14 were produced.

Examples 6 to 8 commonly have top width LH of 3.4 mm, bottom width LB of 3.4 mm, and outer widths LE and LF of 1.8 mm. Examples 6, 7, and 8 have center widths LM of 0.1 mm, 1 mm, and 3 mm, respectively. A current of 11A having a frequency of 100 kHz was supplied to the samples of Examples 6 to 8 so as to measure leakage magnetic flux densities at positions P1 to P4 shown in FIG. 6. FIG. 8 shows the leakage magnetic flux densities of the samples Examples 6 to 8 and Comparative Example.

Examples 9 to 12 commonly have top width LH of 3.4 mm, bottom width LB of 3.4 mm, and center width LM of 1.0 mm. Examples 9, 10, 11, and 12 have outer widths LE and LF of 1 mm, 1.8 mm, 2.8 mm, and 3.7 mm, respectively. A current of 11A having a frequency of 100 kHz was supplied to the samples of Examples 9 to 12 so as to measure leakage magnetic flux densities at positions P1 to P4 shown in FIG. 6. FIG. 9 shows the leakage magnetic flux densities of the samples of Examples 9 to 12 and Comparative Example.

Examples 13 to 17 commonly have center width LM of 1.0 mm and outer widths LE and LF of 1.8 mm. Examples 13, 14, 15, 16, and 17 have top width LH of 1 mm, 2 mm, 3.4 mm, 4 mm, and 5 mm and bottom width LB of 1 mm, 2 mm, 3.4 mm, 4 mm, and 5 mm, respectively. A current of 1A having a frequency of 100 kHz was supplied to the samples of Examples 13 to 17 so as to measure leakage magnetic flux densities at positions P1 to P4 shown in FIG. 6. FIG. 10 shows the leakage magnetic flux densities of Examples 13 to 17 and Comparative Example.

Example 1 shown in FIG. 7, Example 7 shown in FIG. 8, Example 10 shown in FIG. 9, and Example 15 shown in FIG. 10 are identical to each other.

Examples 6 to 8 shown in FIG. 8 which are different only in center width LM out of top width LH, bottom width LB, center width LM, and outer widths LE and LF are not very different from each other in the leakage magnetic field density. Examples 9 to 12 shown in FIG. 9 which are different only in outer widths LE and LF out of top width LH, bottom width LB, center width LM, and outer widths LE and LF are not very different from each other in the leakage magnetic field density. Examples 13 to 17 which are different only in top width LH and bottom width LB out of top width, bottom width LB, center width LM, and outer widths LE and LF are very different from each other in the leakage magnetic field density. Thus, large top width LH and large bottom width LB reduce the leakage magnetic flux density.

As described above, top width LH and bottom width LB are larger than outer widths LE and LF and center width LM to significantly reduce the leakage magnetic flux density. In particular, top width LH and bottom width LB are twice larger than outer widths LE and LF and center width LM to significantly reduce the leakage magnetic flux density.

In the above-mentioned Examples, as shown in FIG. 1, ends 10A and 10B of coils 12 and 13 are electrically connected to external terminals 15 and 16 provided on package 14, respectively. Alternatively, ends 10A and 10B of coils 12 and 13 may extend to the outside of package 14 so as to function as external terminals instead of external terminals 15 and 16. This structure eliminates the joint between end 10A and external terminal 15 and the joint between end 10B and external terminal 16, thereby improving joint reliability.

External terminals 15 and 16 fixed to package 14 can be arranged more arbitrarily since coil devices 7 and 57 according to Embodiments 1 and 2 have low leakage magnetic flux densities. That is, magnetic flux emitted from the surface of package 14 to the outside is suppressed. Therefore, even if external terminals 15 and 16 are made of conductive material which shielding magnetic flux, fixed portions 15A and 16A embedded in package 14 are prevented from shielding magnetic flux flowing in windings 8, 9, 20, 20A to 20D, 21, and 21A to 21D. Thus, regardless of the locations of external terminals 15 and 16, coils 12, 13, 112, and 113 having windings 8, 9, 20, 20A to 20D, 21, and 21A to 21D can provide stable inductance.

Fixed portions 15A and 16A of external terminals 15 and 16 do not reach inner peripheries of windings 8, 9, 20, 20A to 20D, 21, and 21A to 21D. In the case that fixed portions 15A and 16A (external terminals 15 and 16) are made of conductive material which shields magnetic flux, magnetic fluxes M82 and M92 shown in FIG. 2 can be reduce by changing the sizes of fixed portions 15A and 16A embedded in package 14, thereby controlling the magnetroresistance of fixed portions 15A and 16A. This structure allows the magnetic flux flowing in coil device 7 to approximate the magnetic flux flowing in the internal magnet-type magnetic circuit forming a loop of magnetic fluxes M81 and M91 generated by coils 12 and 13. As a result, package 14 made of magnetic material can function as a toroidal core having a high magnetic efficiency. Magnetic fluxes M82 and M92 flow through portions 14A and 14E of package 14 outside coils 12 and 13. Package 14 prevents small magnetic fluxes M82 and M92 from leaking to an outside, thereby reducing leakage magnetic field.

In coil device 7 (57) according to Embodiment 1 shown in FIG. 1, end 10B of coil 12 (112) and end 11B of coil 13 (113) are connected to each other.

Conductor wire 8A of coil 12 (112) and conductor wire 9A of coil 13 (113) may be made of a single conductor wire. In this case, coil 12 (112) and coil 13 (113) may be formed by folding the solenoid coil at the center so as to face the windings of both sides. This structure eliminates the joint between coil 12 (112) and coil 13 (113), thereby improving reliability of coil device 7 (57).

In this case, coil 12 (112) and coil 13 (113) have substantially the same shape and be arranged symmetrically to each other with respect to center line 19A by forming the solenoid coil to a uniform shape. This structure allows magnetic flux M81 generated by coil 12 (112) and magnetic flux M91 generated by coil 13 (113) to have the same magnitude and to flow in directions opposite to each other, thereby reducing magnetic flux leaking from package 14.

In the case that coils 12 and 13 (112 and 113) are formed by folding the single solenoid coil, and the solenoid coil which is folded is accommodated in package 14, so that the folded coil provides package 14 with a spring back force. The spring back force produces the largest moment at four corners 27 in package 14. Package 14 has large cross sectional areas at four corners 27, hence dispersing the moment. Thus, package 14 maintains its strength to reduce cracks, thereby preventing magnetic property from deteriorating.

Alternatively, ends 10B and 11B of coils 12 (112) and 13 (113) may be connected to each other outside package 14. In this case, the connection among ends 10A, 10B, 11A, and 11B of coils 12 and 13 (112 and 113) can be changed. This structure can change the directions of the magnetic fluxes generated by coils 12 and 13 (112 and 113), allowing coil device 7 (57) to function as selectively an inductor and a noise filter.

Figure 11A:
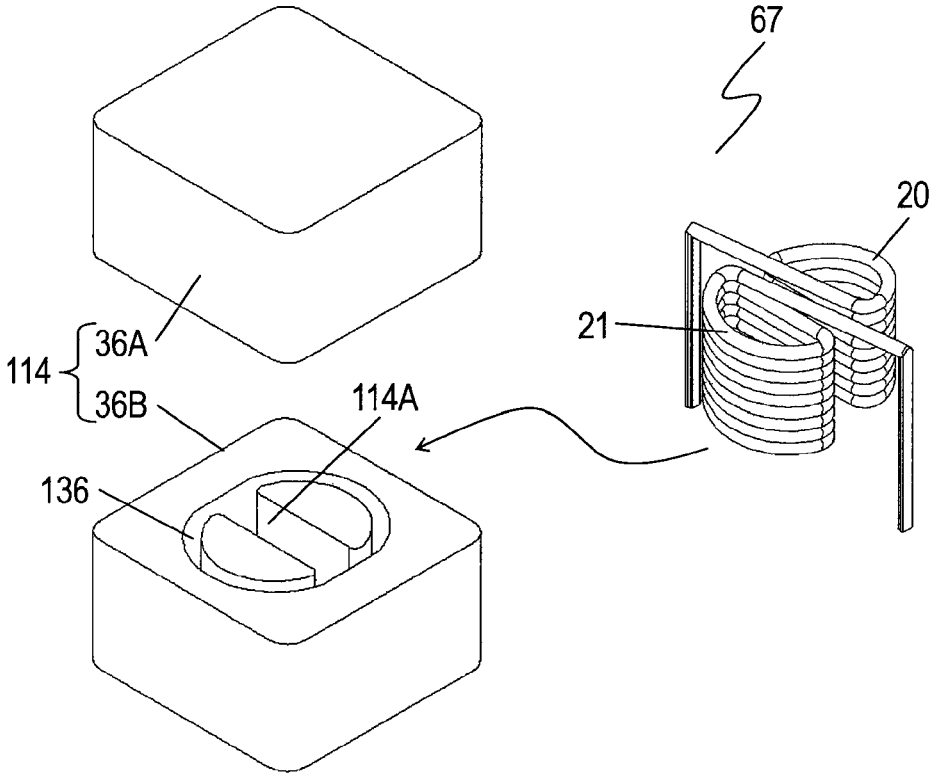
FIG. 11A is an exploded perspective view of a further coil device according to Embodiment 2.
Figure 11B:
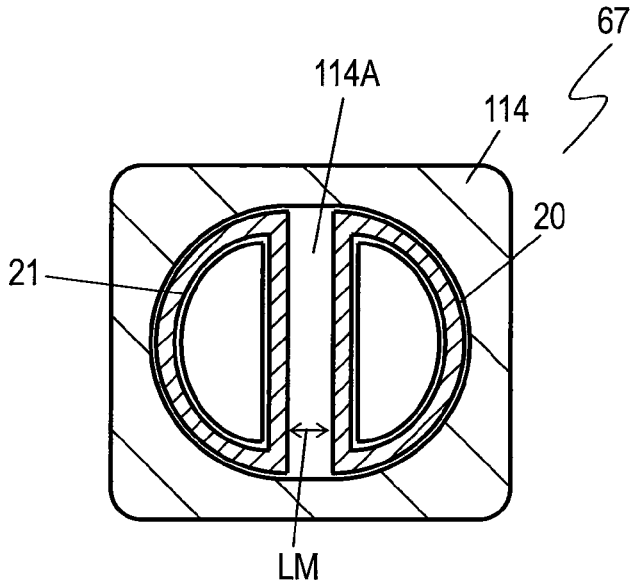
FIG. 11B is a sectional view of the coil device shown in FIG. 11A.

FIG. 11A is an exploded perspective view of another coil device 67 according to Embodiment 2. FIG. 11B is a sectional view of coil device 67. In FIGS. 11A and 11B, components identical to coil device 57 shown in FIGS. 3 and 4 are denoted by the same reference numerals, and their description will be omitted. Coil device 67 of FIGS. 11A and 11B includes package 114 made of magnetic material instead of package 14 of coil device 57 shown in FIGS. 3 and 4. In coil device 57 shown in FIG. 3, windings 20 and 21 face each other across portion 14C of package 14. In coil device 67 shown in FIG. 11A, on the other hand, windings 20 and 21 have hollow portion 114A between windings 20 and 21, so that linear portions 22 and 23 of windings 20 and 21 face each other by the center width LM without any portion of package 114 between windings 20 and 21. Package 114 includes cores 36A and 36B which are formed by molding magnetic material, such as ferrite or powder containing magnetic powder and bonding material. Cores 36A and 36B have recess 136 provided therein for accommodating windings 20 and 21 therein.

A sample of Example 18 of coil device 67 was produced. Example 18 was identical to Example 1 of coil device 57 in top width LH, bottom width LB, center width LM, and outer widths LE and LF. A current of 11A having a frequency of 100 kHz was supplied to the sample of Example 18 so as to measure leakage magnetic flux densities at positions P1 to P4 shown in FIG. 6. FIG. 12 shows the leakage magnetic flux densities of the samples of Examples 1 and 18 and Comparative Example.

As shown in FIG. 12, Examples 1 and 18 have the same leakage magnetic flux density, and nearly the same inductances. More specifically, the magnetic flux leaking from packages 14 and 114 and the inductances are almost identical to each other between coil device 67 in which windings 20 and 21 face each other directly and coil device 57 in which windings 20 and 21 face each other across portion 14C of package 14 made of magnetic material. Portions of the magnetic fluxes generated by windings 20 and 21 flowing through portion 14C of package 14 made of magnetic material offset each other. Portion 14C of package 14 does not influence to the magnetic fluxes, and hence, does not influence to characteristics of coil device 57. Hollow portion 114A provided in cores 36A and 16B simplifies the design of the molds for shaping cores 36A and 36B shown in FIGS. 11A and 11B, and reduces the amount of the magnetic material used for cores 36A and 36B.

In this case, top width LH and bottom width LB are preferably equal to each other. This structure allows magnetic fluxes M81 and M91 to flow efficiently in a loop in package 14 shown in FIG. 2.

Figure 13:
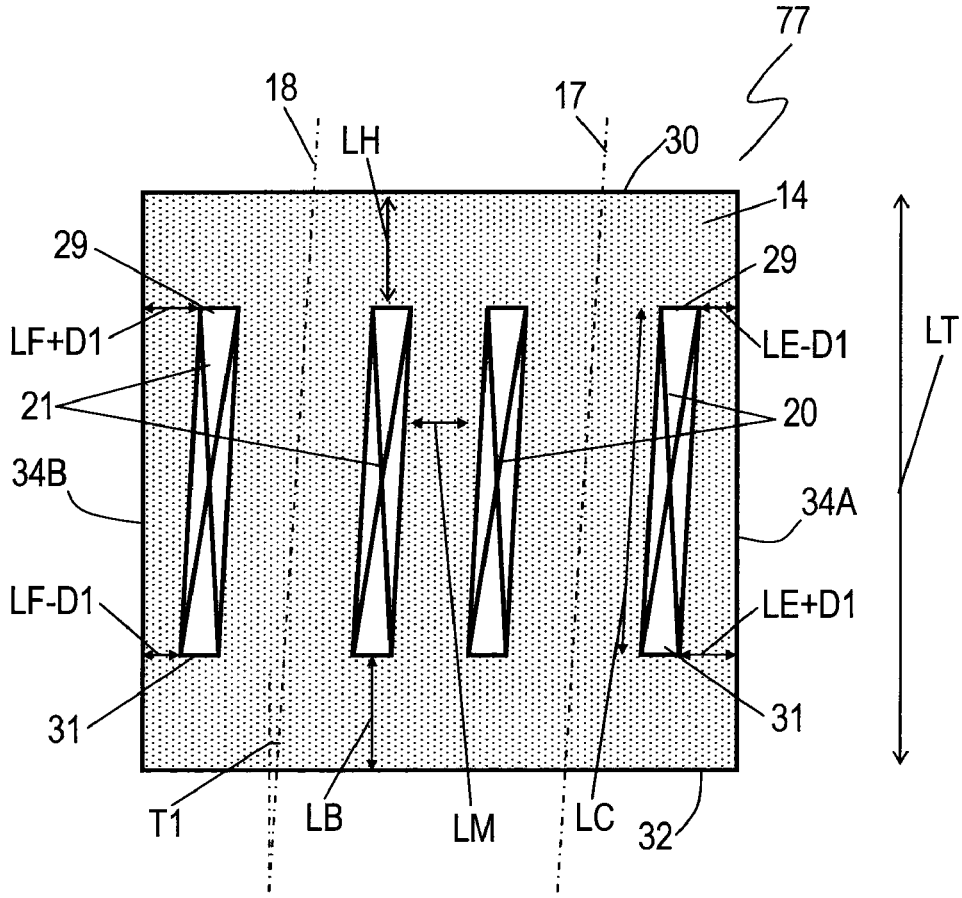
FIG. 13 is a sectional view of a further coil device according to Embodiment 2.

FIG. 13 is a sectional view of another coil device 77 according to Embodiment 2. In FIG. 13, components identical to those of coil device 57 shown in FIG. 6 are denoted by the same reference numerals, and their description will be omitted. In coil device 57 shown in FIG. 6, winding axes 17 and 18 of windings 20 and 21 are parallel to side surfaces 34A and 34B of package 14. In coil device 77 shown in FIG. 13, winding axes 17 and 18 incline by angle T1 with respect to side surfaces 34A and 34B. Therefore, the outer width, the distance between upper end 29 of winding 20 and side surface 34A is LE−D1, while the outer width, the distance between lower end 31 of winding 20 and side surface 34A is LE+D1. Similarly, the outer width, the distance between upper end 29 of winding 21 and side surface 34B is LF+D1, while the outer width, the distance between lower end 31 of winding 21 and side surface 34B is LF−D1. As shown in FIGS. 8 to 10, top width LH and bottom width LB influence significantly to the leakage magnetic field than the outer widths do. Winding axes 17 and 18 inclining with respect to side surfaces 34A and 34B reduce width LT of side surfaces 34A and 34B along winding axes 17 and 18, while maintaining length LC of windings 20 and 21 along winding axes 17 and 18, top width LH, and the bottom width LB. This structure increases the inductance of coil device 57 if package 14 has a predetermined size, or this structure reduces the size of package 14 if coil device 57 has a predetermined inductance.

Center width LM shown in FIG. 13 does not influence significantly to the magnetic fluxes generated by windings 20 and 21 if center width LM is half or less than half the top width LH and the bottom width LB. Therefore, windings 20 and 21 may not necessarily be parallel to each other. In this case, the largest distance between windings 20 and 21 is preferably half or less than half the top width LH and the bottom width LB.

Figure 14:
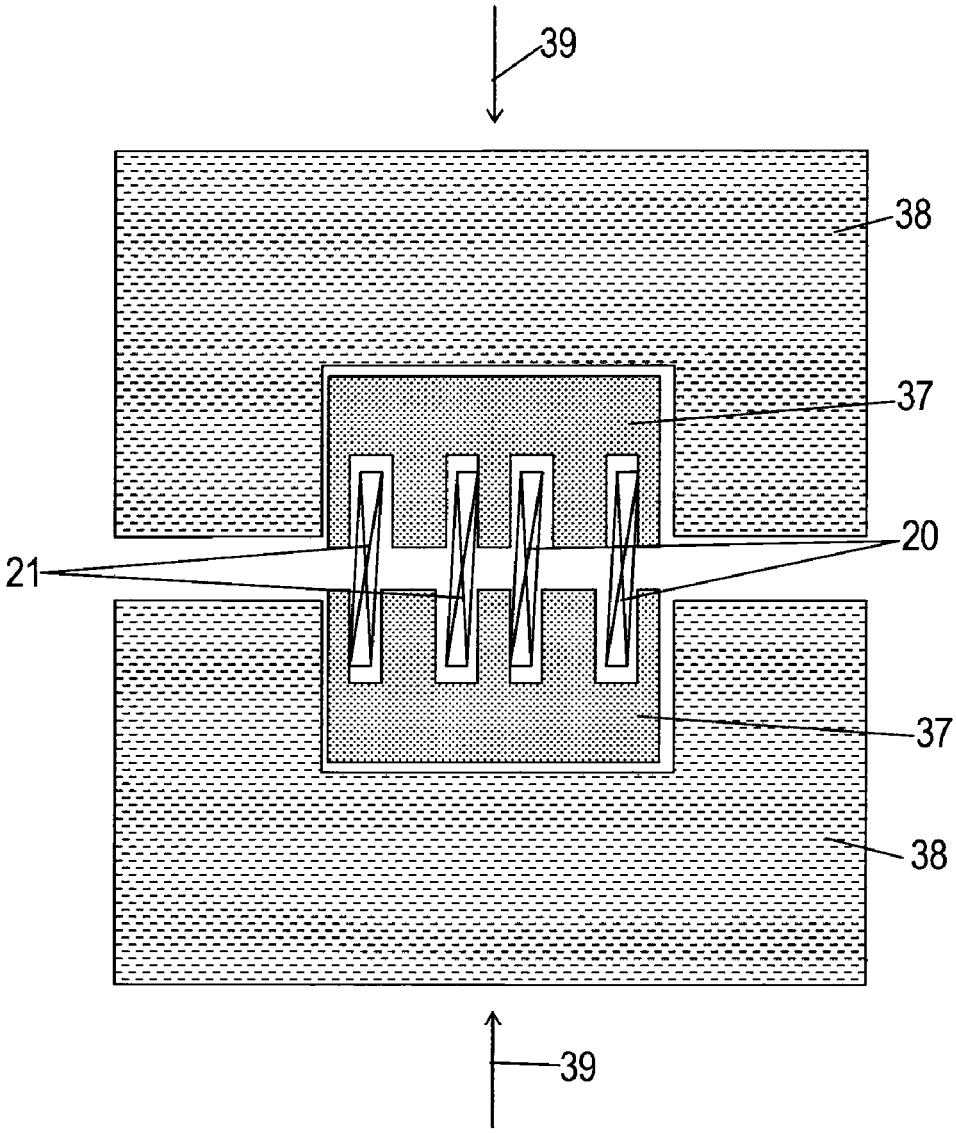
FIG. 14 is a sectional view of the coil device according to Embodiment 2 for illustrating a method of manufacturing the coil device.

FIG. 14 is a sectional view of coil device 77 for illustrating a method of manufacturing coil device 77. In the case that windings 20 and 21 (winding axes 17 and 18) incline with respect to side surfaces 34A and 34B of package 14, respectively, as shown in FIG. 14, package 14 shown in FIG. 13 is formed as follows. First, windings 20 and 21 are covered with semi-cured magnetic core 37 which is not completely molded, and then, semi-cured magnetic core 37 is cured by being pressed with upper and lower molds 38. Semi-cured magnetic core 37 may be powder of the magnetic material or an aggregate formed by temporarily molding powder of the magnetic material. The powder of the magnetic body of semi-cured magnetic core 37 is partially collapsed while being pressure-molded with molds 38. Therefore, direction 39 in which molds 38 press semi-cured magnetic core 37 is not parallel to winding axes 17 and 18 of windings 20 and 21. Even in this case, as shown in FIG. 14, the powder of the magnetic material covers windings 20 and 21, and entering into insides of windings 20 and 21 so as to form package 14. Semi-cured magnetic core 37 is preferably made of mixture of magnetic powder and bonding material so as to be pressure-molded with molds 38.

Figure 15:
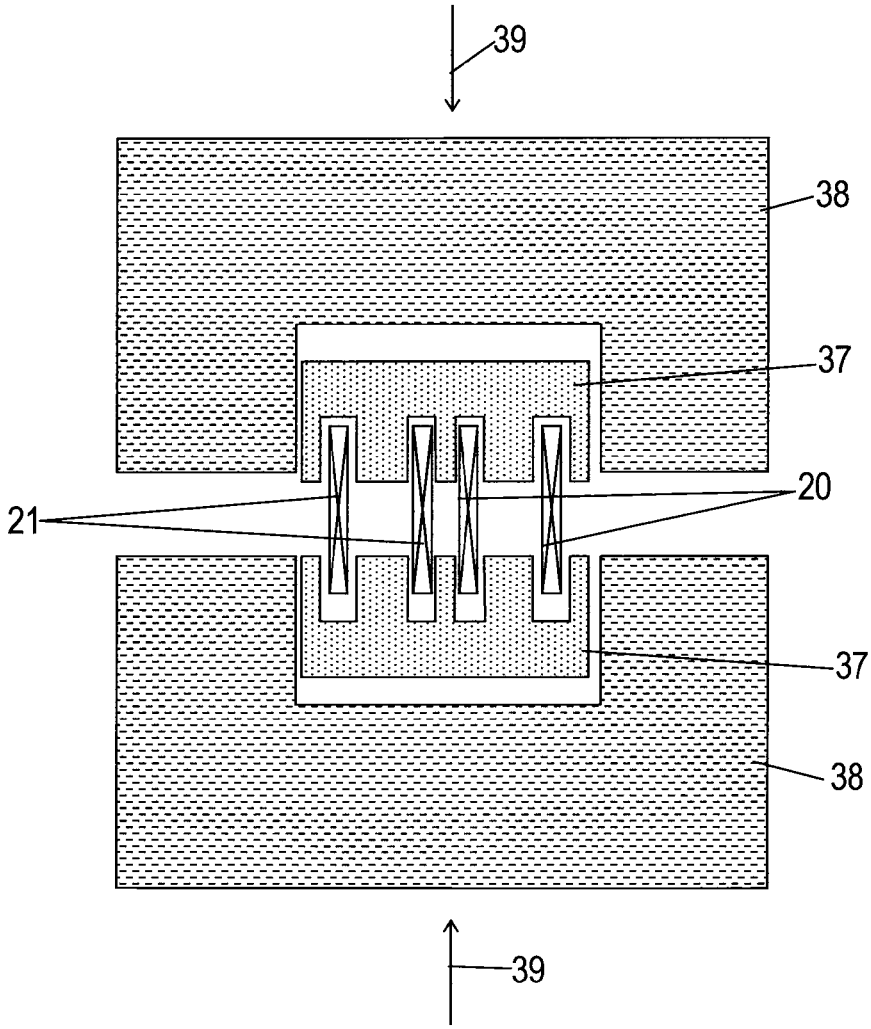
FIG. 15 is a sectional view of the coil device according to Embodiment 2 for illustrating another method of manufacturing the coil device.

FIG. 15 is a sectional view of coil device 77 for illustrating another method of manufacturing coil device 77. As shown in FIG. 15, while winding axes 17 and 18 of windings 20 and 21 are parallel with direction 39 in which molds 38 press semi-cured magnetic core 37, semi-rigid magnetic core 37 is pressure-molded. Windings 20 and 21 (winding axes 17 and 18) may incline with respect to side surfaces 34A and 34B of package 14 by the pressure applied during the pressure-molding, as shown in FIG. 13.

Terms indicating directions, such as "upper end", "lower end", "upper surface, "lower surface", and "side surface" do not indicate absolute directions, such as vertical directions, and do indicate relative directions depending on the positions of component parts, such as coils 12, 13, 112, and 113 and packages 14 and 114, of coil devices 7, 57, 67, and 77

INDUSTRIAL APPLICABILITY

A coil device according to the present invention reduces the amount of magnetic flux leaking to an outside of a package and is useful in various electronic apparatuses.

The invention claimed is:

1. A coil device comprising:

a first coil having a first winding including a first conductor wire wound about a first winding axis, and first and second ends which are both ends of the first conductor wire;

a second coil having a second winding including a second conductor wire wound about a second winding axis, the second winding axis being arranged with the first winding axis, and third and fourth ends which are both ends of the second conductor wire;

a package for sealing the first winding of the first coil and the second winding of the second coil, the package being made of magnetic material, wherein the first winding of the first coil and the second winding of the second coil are separated via the package, the second end of the first coil is connected with the third end of the second coil, and the first end of the first coil and the fourth end of the second coil are adapted to be connected to an outside of the package.

2. The coil device of claim 1, wherein the second end of the first coil and the third end of the second coil are connected to each other in the package.

3. The coil device of claim 1, wherein the second end of the first coil and the third end of the second coil are connected to each other at an outside of the package.

4. The coil device of claim 1, further comprising:

a first external terminal connected to the first end of the first coil, the first external terminal being provided on the package; and a second external terminal connected to the fourth end of the second coil, the second external terminal being provided on the package.

5. The coil device of claim 1, wherein the package is made of molded magnetic material.

6. The coil device of claim 1, wherein the first conductor wire of the first coil and the second conductor wire of the second coil are made of a single conductor wire.

7. The coil device of claim 1, wherein the first winding of the first coil and the second winding of the second coil are symmetrical to each other with respect to a plane between the first winding and the second winding.

8. The coil device of claim 1, wherein the first winding of the first coil has a cross section perpendicular to the first winding axis, the cross section being formed of a first linear portion and a first outer periphery, the second winding of the second coil has a cross section perpendicular to the second winding axis, the cross section being formed of a second linear portion and a second outer periphery, the first linear portion of the first coil faces the second linear portion of the second coil, a region surrounded by the first outer periphery decreases as being away from the first linear portion, and a region surrounded by the second outer periphery decreases as being away from the second linear portion.

9. The coil device of claim 1, wherein the first winding of the first coil has a cross section perpendicular to the first winding axis, the cross section being a partial circular shape having a first linear portion and a first arcuate portion, the second winding of the second coil has a cross section perpendicular to the second winding axis, the cross section being a partial circular shape having a second linear portion and a second arcuate portion, and the first linear portion of the first coil faces the second linear portion of the second coil.

10. The coil device of claim 9, wherein the first linear portion of the first coil and the second linear portion of the second coil face each other directly with a predetermined distance between the first and second linear portions.

11. The coil device of claim 9, wherein the first winding axis and the second winding axis are arranged in a predetermined direction, the package has an upper surface facing an upper end of the first winding and an upper end of the second winding, a lower surface facing a lower end of the first winding and a lower end of the second winding, a first side surface located in the predetermined direction from the first winding, the first side surface facing the first winding, and a second side surface located in the predetermined direction from the second winding, the second side surface facing the second winding, a distance between the upper end of the first winding and the upper surface of the package and a distance between the lower end of the first winding and the lower surface of the package are larger than a distance between the first winding and the first side surface of the outer member and a distance between the first linear portion of the first winding and the second linear portion of the second winding, and a distance between the upper end of the second winding and the upper surface of the package and a distance between the lower end of the second winding and the lower surface of the package are larger than a distance between the second winding and the second side surface of the outer member.

12. The coil device of claim 11, wherein the first winding axis and the second winding axis incline with respect to the first side surface and the second side surface of the package.

13. A coil device comprising:

a first coil having a first winding including a first conductor wire wound about a first winding axis, and first and second ends which are both ends of the first conductor wire;

a second coil having a second winding including a second conductor wire wound about a second winding axis, the second winding axis being arranged with the first winding axis, and third and fourth ends which are both ends of the second conductor wire;

a package for sealing the first winding of the first coil and the second winding of the second coil, wherein the second end of the first coil is connected with the third end of the second coil, the first end of the first coil and the fourth end of the second coil are adapted to be connected to an outside of the package, the first winding of the first coil has a cross section perpendicular to the first winding axis, the cross section being a partial circular shape having a first linear portion and a first arcuate portion, the second winding of the second coil has a cross section perpendicular to the second winding axis, the cross section being a partial circular shape having a second linear portion and a second arcuate portion, and the first linear portion of the first coil faces the second linear portion of the second coil.

14. The coil device of claim 13, wherein the first winding of the first coil and the second winding of the second coil are symmetrical to each other with respect to a plane between the first winding and the second winding.

15. The coil device of claim 13, wherein the first linear portion of the first coil and the second linear portion of the second coil face each other directly with a predetermined distance between the first and second linear portions.

16. The coil device of claim 13, wherein the first winding axis and the second winding axis are arranged in a predetermined direction, the package has an upper surface facing an upper end of the first winding and an upper end of the second winding, a lower surface facing a lower end of the first winding and a lower end of the second winding, a first side surface located in the predetermined direction from the first winding, the first side surface facing the first winding, and a second side surface located in the predetermined direction from the second winding, the second side surface facing the second winding, a distance between the upper end of the first winding and the upper surface of the package and a distance between the lower end of the first winding and the lower surface of the package are larger than a distance between the first winding and the first side surface of the outer member and a distance between the first linear portion of the first winding and the second linear portion of the second winding, and a distance between the upper end of the second winding and the upper surface of the package and a distance between the lower end of the second winding and the lower surface of the package are larger than a distance between the second winding and the second side surface of the outer member.

17. The coil device of claim 13, wherein the first winding axis and the second winding axis incline with respect to the first side surface and the second side surface of the package.

* * * * *

UNITED STATES PATENT AND TRADEMARK OFFICE

CERTIFICATE OF CORRECTION

PATENT NO. : 8,049,588 B2
APPLICATION NO. : 12/519833
DATED : November 1, 2011
INVENTOR(S) : Tomonori Shibuya et al.

It is certified that error appears in the above-identified patent and that said Letters Patent is hereby corrected as shown below:

In column 14, line 31, please delete "13" and instead insert --16--

Signed and Sealed this
Third Day of April, 2012

David J. Kappos

David J. Kappos
*Director of the United States Patent and Trademark Office*